US007896262B2

(12) United States Patent
Suzuki et al.

(10) Patent No.: US 7,896,262 B2
(45) Date of Patent: Mar. 1, 2011

(54) FUEL INJECTION VALVE FOR INTERNAL COMBUSTION ENGINE

(75) Inventors: Kazunori Suzuki, Nagoya (JP); Atsushi Oozono, Kariya (JP)

(73) Assignee: Denso Corporation, Kariya (JP)

( * ) Notice: Subject to any disclaimer, the term of this patent is extended or adjusted under 35 U.S.C. 154(b) by 126 days.

(21) Appl. No.: 12/341,232

(22) Filed: Dec. 22, 2008

(65) Prior Publication Data

US 2009/0159728 A1 Jun. 25, 2009

(30) Foreign Application Priority Data

Dec. 25, 2007 (JP) ..... 2007-332574

(51) Int. Cl.
*B05B 1/30* (2006.01)

(52) U.S. Cl. ..... 239/584; 239/585.5

(58) Field of Classification Search ..... 239/88–96, 239/533.2, 533.11, 584, 585.1–585.5, DIG. 19; 251/129.15, 129.21, 127
See application file for complete search history.

(56) References Cited

U.S. PATENT DOCUMENTS 4,007,880 A * 2/1977 Hans et al. ..... 239/585.5
4,148,863 A * 4/1979 Farafontov et al. ..... 423/290
5,061,513 A 10/1991 Flynn et al.
5,231,959 A * 8/1993 Smietana ..... 123/90.12
5,373,993 A 12/1994 Flynn et al.
5,391,233 A 2/1995 Flynn et al.
2004/0187798 A1* 9/2004 Schneider et al. ..... 123/1 A
2005/0067512 A1* 3/2005 Shimizu et al. ..... 239/585.1

FOREIGN PATENT DOCUMENTS

JP WO 91/15611 10/1991
JP 3174321 3/2001
JP 2001-090638 4/2001

OTHER PUBLICATIONS

Japanese Office Action dated Oct. 20, 2009, issued in corresponding Japanese Application No. 2007-332574, with English translation.

* cited by examiner

*Primary Examiner*—Davis Hwu
(74) *Attorney, Agent, or Firm*—Nixon & Vanderhye PC

(57) ABSTRACT

A fuel injection valve has a valve guide, a valve member movable in a center opening of the valve guide along an axial direction of the valve guide, and a covering layer disposed on a surface of the valve guide. The valve guide has a valve seat placed on an inner surface thereof and a nozzle hole from which fuel is injected. The valve member is seated on the valve seat to close the nozzle hole and leaves the valve seat to open the nozzle hole. The covering layer is placed around an outlet opening of the nozzle hole. The covering layer is made of boron nitride in a hexagonal crystal system so as to have a hydrophilic property higher than that of the surface of the valve guide.

7 Claims, 5 Drawing Sheets

FUEL INJECTION VALVE FOR INTERNAL COMBUSTION ENGINE

CROSS-REFERENCE TO RELATED APPLICATION

This application is based upon and claims the benefit of priority of the prior Japanese Patent Application 2007-332574 filed on Dec. 25, 2007, so that the contents of which are incorporated herein by reference.

BACKGROUND OF THE INVENTION

1. Field of the Invention

The present invention relates to a fuel injection valve which injects fuel into a combustion chamber of an internal combustion engine or the like.

2. Description of Related Art

An internal combustion engine has a fuel injection valve for injecting fuel into each of a plurality of combustion chambers. This injection valve has a valve guide formed in a cylindrical shape and a valve member. The valve guide has nozzle holes. The valve member is disposed in a center opening of the guide. The valve member is reciprocated to be seated on a valve seat of the guide and to leave the seat. Therefore, the holes are repeatedly opened and closed. A fuel passage is formed between the valve guide and the valve member. When the valve member leaves the seat, fuel flows through the fuel passage and is injected into the chamber through the holes.

Because each hole is formed in a small size, a portion of the fuel injected through the hole easily remains as residues on a surface of the valve guide placed around fuel outlets of the holes. These fuel residues are exposed to combustion products (e.g., $CO_2$, CO, $H_2O$, NO, and the like) having high temperatures during the operation of the engine. Further, when the operation of the engine is stopped, the residues are cooled down. Therefore, the residues are solidified or caked as deposits on the valve guide around the fuel outlets of the holes. These deposits placed around the holes change the spray angle of the injected fuel and/or the shape of the spray formed by the injected fuel. In this case, it is difficult to maintain the fuel injection performance of the injection valve at a superior level.

To solve this problem, Published Japanese Patent First Publication No. 2001-90638 discloses a fuel injection valve wherein an organic layer made of perfluoropolyether compound such as FAS (fluoro-alkyl-silane) or the like is attached to the surface of a valve guide around nozzle holes of the guide. FAS has water repellency. The FAS layer prevents fuel from being attached to the surface of the valve guide as deposits, or the deposits attached to the surface of the valve guide are easily detached due to the FAS layer.

However, this injection valve in the Publication No. 2001-90638 has the problem that FAS thermally decomposed is attached to the surface of the valve guide More specifically, a portion of the valve guide on the downstream side of the holes is heated by combustion products. Therefore, FAS attached to the surface of the valve guide is thermally decomposed and reacts with P, Zn, Si, compounds of carboxylic acids and base components, and the like contained in the fuel to produce low melting amorphous glass. Therefore, PAS thermally decomposed has no water repellent performance. Further, the low melting amorphous glass derived from thermally decomposed FAS and fuel residues containing non-burned carbon forms deposits, and these deposits become fixed and attached to the surface of the valve guide around the holes.

SUMMARY OF THE INVENTION

An object of the present invention is to provide, with due consideration to the drawbacks of the conventional valve, a fuel injection valve which prevents deposits from being attached to the surface of a valve guide around a nozzle hole of the guide.

According to an aspect of this invention, the object is achieved by the provision of a fuel injection valve comprising a valve guide with a valve seat placed on an inner surface of the valve guide and a nozzle hole from which fuel is injected, a valve member movable along an axial direction of the valve guide to be seated on the valve seat of the valve guide and to leave the valve seat, and a covering layer disposed on a surface of the valve guide around an outlet opening of the nozzle hole. The valve member seated on the valve seat closes the nozzle hole of the valve guide. The valve member leaving the valve seat opens the nozzle hole. The covering layer has a hydrophilic property higher than that of the surface of the valve guide.

With this structure of the injection valve, when the nozzle hole is opened, fuel is injected through the nozzle hole. In this case, a portion of the injected fuel remains on the covering layer disposed on the outer surface of the valve guide. Because the covering layer has a hydrophilic property higher than that of the surface of the valve guide, the covering layer prevents the fuel remaining on the layer from being solidified or caked as deposits on the layer around the outlet opening of the nozzle hole.

More specifically, the covering layer having a high hydrophilic property successively collects water contained in the fuel and forms a film of the water on the layer. When a portion of fuel injected from the hole remains on the covering layer as residues containing non-burned carbons, P, Zn, Si, compounds of carboxylic acids and base components, and the like, the fuel residues float on the water film. In this case, the injection flow of the fuel easily removes the fuel residues from the water film successively formed. Therefore, the covering layer prevents a portion of fuel from being remaining as residues on the layer. That is, the covering layer prevents the generation of deposits from fuel residues and the deposition of the deposits on the layer.

Because deposits are not substantially formed around the outlet opening of the nozzle hole, a flow rate of the injected fuel and a spray angle of the injected fuel can be maintained at adequate values even when an engine with the injection valve is intermittently operated for a long time.

Accordingly, because the covering layer having a high hydrophilic property is disposed on the surface of the valve guide around the outlet opening of the nozzle hole, the injection valve can prevent deposits of fuel from being solidified or caked on the surface of the valve guide around the outlet openings of the holes. As a result, the injection valve can maintain the fuel injection performance such as a flow rate of fuel and a spray angle of fuel at superior levels.

DETAILED DESCRIPTION OF THE PREFERRED EMBODIMENTS

Figure 1:
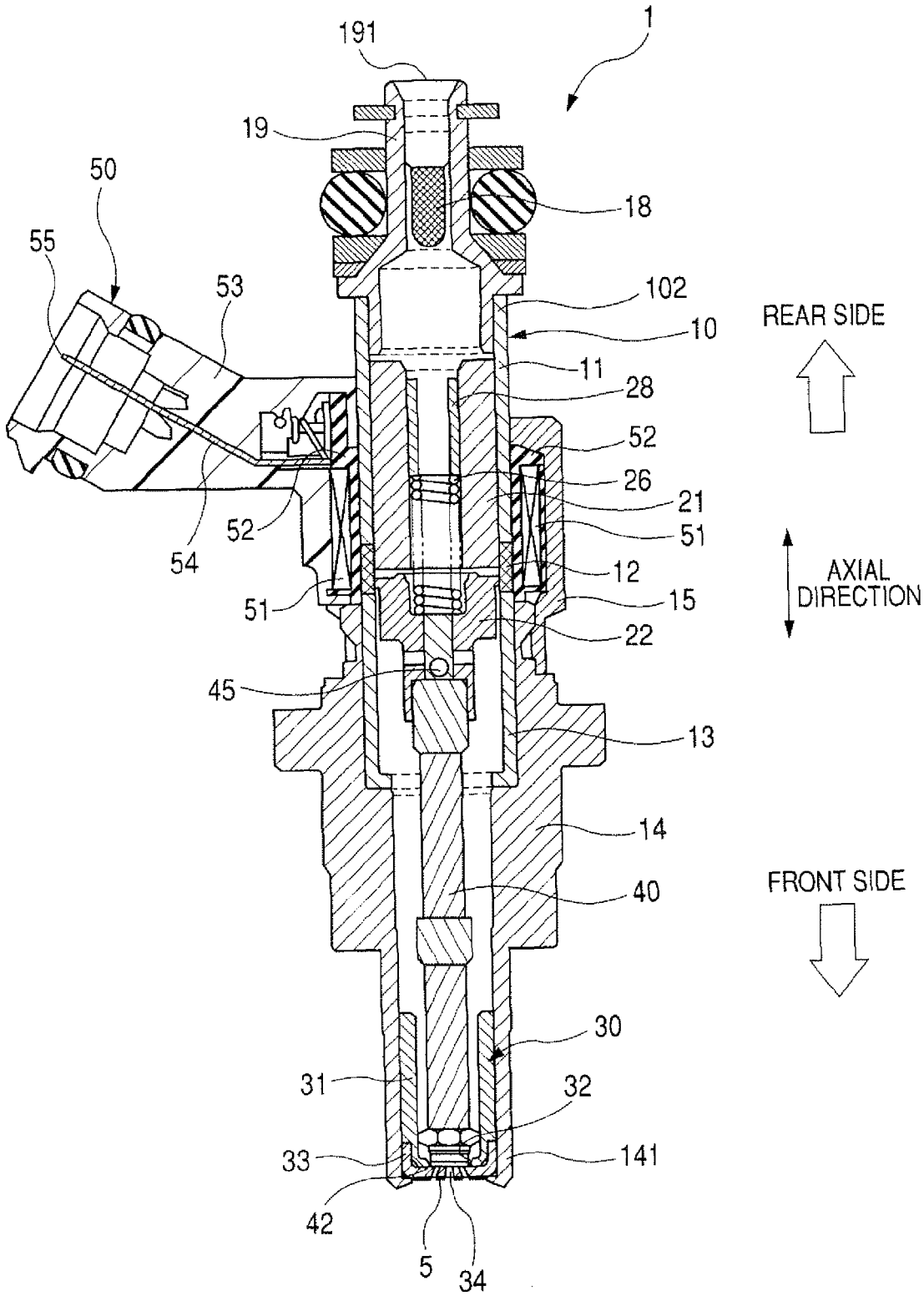
FIG. 1 is a longitudinal sectional view of a fuel injection valve according to the first embodiment of the present invention.

Embodiments of the present invention will now be described with reference to the accompanying drawings, in which like reference numerals indicate like parts, members or elements throughout the specification unless otherwise indicated.

Embodiment 1

Figure 2:
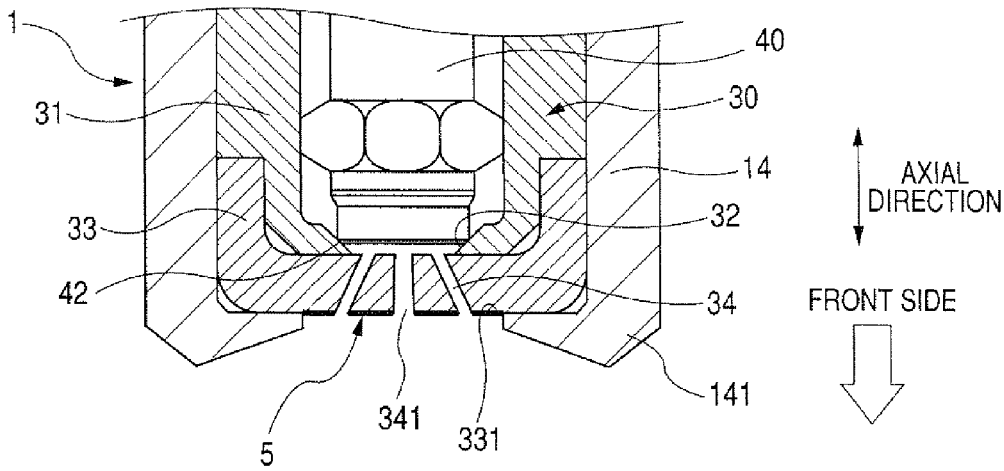
FIG. 2 is an enlarged view of a covering layer attached to a surface of a nozzle body in the injection valve shown in FIG. 1.

FIG. 1 is a longitudinal sectional view of a fuel injection valve according to the first embodiment, while FIG. 2 is an enlarged view of a covering layer attached to a surface of a nozzle body in the injection valve shown in FIG. 1.

A fuel injection valve (hereinafter, called an injector) 1 shown in FIG. 1 is, for example, attached to each of engine heads of a direct injection type gasoline engine (not shown) to inject gasoline into a combustion chamber of the engine. This injector 1 may be used for a pre-mixed type gasoline engine or a diesel engine. As a type of fuel injection valve, a fuel adding valve is used for a NOx reducing process or a particulate matter regeneration process. This fuel adding valve adds fuel into an exhaust gas passage to regenerate the exhaust catalyst and prevent lowering the performance of exhaust emission control.

As shown in FIG. 1 and FIG. 2, the injector 1 has a cylindrical housing 10 composed of a first magnetic member 11, a non-magnetic member 12 disposed on the front side of the member 11 and a second magnetic member 13 disposed on the front side of the member 12. The members 11 to 13 are attached to one another by laser welding or the like to be aligned along the axial direction of the injector 1. Each of the members 11 and 13 is made of a magnetic material. The member 12 is made of anon-magnetic material to prevent the members 11 and 13 from magnetically interacting with each other.

The injector 1 further has a cylindrical external connector 19 tightly fitted to the inner circumferential surface of the housing 10 at a rear end portion 102 of the housing 10, a nozzle holder 14 of which a rear end portion is attached to the outer circumferential surface of the member 13, a cylindrical nozzle body (or a valve guide) 30 fixed to the inner circumferential surface of a front end portion 141 of the holder 14, a cylindrical fixed core 21 fixedly attached to the inner circumferential surfaces of the members 11 and 12 to be disposed in the center opening of the housing 10, a cylindrical movable core 22 disposed in the center opening of the housing 10 on the front side of the core 21 to be reciprocated along the axial direction, and a needle valve (or a valve member) 40 of which a rear portion is attached to a front portion of the core 22 to be disposed in the center openings of the housing 10, the holder 14 and the body 30.

Each of the cores 21 and 22 is made of a magnetic material. The cores 21 and 22 face each other in the axial direction. The core 22 is brought into contact with the core 21 in response to a magnetic attracting force induced between the cores 21 and 22. The body 30 is pressed into the holder 14 and is fixedly attached to the holder 14 by welding or the like. The needle valve 40 and the body 30 are coaxially disposed. The needle valve 40 is reciprocated with the core 22 along the axial direction of the body 30 (i.e., the axial direction of the injector 1).

The nozzle body 30 has a cylindrical nozzle body wall 31 fitted to the portion 141 of the holder 14, a valve seat 32 disposed on the inner circumferential surface of a conically-shaped front end portion of the wall 31, and a nozzle hole plate 33 fixedly disposed between the front end portion of the wall 31 and the holder 14 so as to cover the valve seat 32. The inner diameter of the valve seat 32 is gradually reduced toward the front side, and the valve seat 32 has a circular opening facing the front end of the needle valve 40 in the axial direction and communicating with the opening between the needle valve 40 and the holder 14. The hole plate 33 has a plurality of nozzle holes 34 through which the opening of the seat 32 communicates with the chamber of the engine head. The plate 33 may have a single nozzle hole.

The needle valve 40 has a sealing portion 42 at its front end. This sealing portion 42 can be seated on the valve seat 32 of the nozzle body 30 in response to the needle valve 40 moving toward the front side.

The injector 1 further has a spring 26 disposed in the center openings of the cores 21 and 22 while one end of the spring 26 is in contact with the rear end of the needle valve 40, a cylindrical adjusting pipe 28 fixedly attached to the inner circumferential surface of the core 21 to be disposed in the center opening of the core 21 and being in contact with the other end of the spring 26, and a fuel filter 18 fixedly disposed in the center opening of the connector 19.

The spring 26 acts as an elastic member to produce an elastic force biasing the needle valve 40 toward the front side. The spring 26 pushes the sealing portion 42 of the needle valve 40 toward the valve seat 32 of the nozzle body 30. Therefore, when the core 22 is not attracted to the core 21, the sealing portion 42 can be stably seated on the valve seat 32. A load applied to the spring 26 is adjusted by adjusting the length of the pipe 28 pressed into the core 21. The elastic member is not limited to the spring 26. For example, a blade spring or a damper using gas or liquid may be used as the elastic member.

Fuel of a fuel tank (not shown) is supplied from a fuel inlet 191 placed at the rear end of the connector 19 and flows into the opening of the housing 10 through the filter 18. The filter 18 removes foreign matters contained in the fuel.

The injector 1 further has a coil assembly 50 disposed on the outer circumferential surface of the housing 10 and a plate housing 15. The coil assembly 50 has a coil 51 inducing a magnetic attracting force between the cores 21 and 22, a molding member 52 covering the coil 51, and an electric connector 53 through which the coil 51 receives electric power. The coil 51 is formed in the cylindrical shape so as to surround the housing 10 along the circumferential direction of the injector 1. The molding member 52 is made of resin. The molding member 52 is disposed on both the inner and outer circumferential surfaces of the coil 51 to electrically insulate the coil 51 from the housing 10. The connector 53 has a connector body attached to the molding member 52, a wire 54 connected with the coil 51 while penetrating through the body, and a terminal 55 connected with the wire 54 outside the body. The connector body is made of resin.

The plate housing 15 is attached to the housing 10 and the nozzle holder 14 to cover the outer circumferential surface and the rear surface of the coil 51 through the molding member 52. The plate housing 15 holds the coil 51. The plate housing 15 is made of a magnetic material.

The injector 1 further has a covering layer 5 attached to a surface 331 of the nozzle hole plate 33 of the nozzle body 30. The covering layer 5 is located around a plurality of outlet openings 341 of the respective holes 34. The covering layer 5 is made of a non-organic material having a hydrophilic property higher than that of the surface 331 of the plate 33. The degree of hydrophilic property is indicated by an angle of water repellence. The water repellence angle denotes a contact angle of a water drop indicating the degree of wetting.

The layer 5 is, for example, made of boron nitride (hereinafter, called h-BN) in the hexagonal crystal system. This h-BN is superior in heat resistance, Therefore, the layer 5 is hardly reacted with fuel residues such as non-burned carbons, P, Zn, Si, compounds of carboxylic acids and base components, and the like. The h-BN is, for example, deposited on the surface 331 of the plate 33 according to a plasma chemical vapor deposition (CVD) to form the covering layer 5. The thickness of the layer 5 ranges from 20 nm ($2\times10^{-8}$ m) to 10 μm ($1\times10^{-5}$ m). Assuming that the thickness of the layer 5 is smaller than 20 nm, the layer 5 insufficiently prevents fuel residues from being deposited on the plate 33. Assuming that the thickness of the layer 5 exceeds 10 μm, the layer 5 is easily detached from the plate 33 by the injected fuel. In this embodiment, the layer 5 has the thickness of approximately 0.2 μm.

Figure 3:
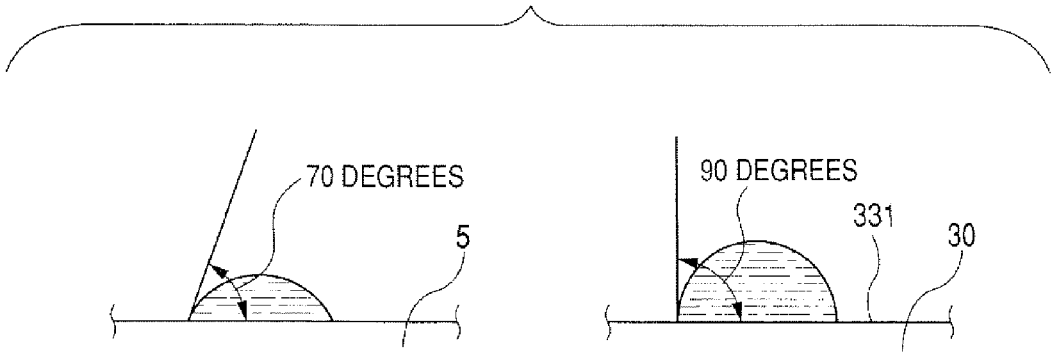
FIG. 3 is an explanatory view showing an angle of water repellence in the covering layer and an angle of water repellence in a nozzle hole plate.

As shown in FIG. 3, the covering layer 5 made of h-BN has an angle of water repellence equal to approximately 70 degrees. In contrast, the plate 33 is, for example, made of a type of stainless steel such as SUS 304. SUS 304 contains Ni ranging from 8.00 to 10.50 wt %, Cr ranging from 18.00 to 20.00 wt %, C (C≦0.08 wt %), Si (≦1.00 wt %), Mn (≦2.00 wt %), P (≦0.045 wt %) ands (≦0.030 wt %). The surface 331 of the plate 33 made of SUS 304 has an angle of water repellence equal to approximately 90 degrees. Because the water repellence angle of the covering layer 5 is smaller than that of the surface 331 of the plate 33, the covering layer 5 has the hydrophilic property higher than that of the surface 331 of the plate 33.

The inventors of this application actually measured the angle of water repellence. In this measurement, a drop of water from a micro syringe was dropped on the surface of the covering layer 5. Then, light was emitted to the water drop from one side of the layer 5, a camera located on the other side of the layer 5 received the light, and an image indicating the shape of the water drop was obtained. Then, the contact angle of the water drop located on the surface of the layer 5 was measured to obtain the water repellence angle of h-BN. In the same manner, the inventors measured the water repellence angle of SUS 304.

Next, an operation of the injector 1 will be described below.

During the stoppage of electric power to the coil 51, no magnetic attracting force is induced between the cores 21 and 22. Therefore, the core 22 is placed due to the pushing force of the spring 26 to be away from the core 21, and the sealing portion 42 of the needle valve 40 is seated on the valve seat 32 of the nozzle body 30. Therefore, the injector 1 is set in the valve closing state, and fuel is not injected from any nozzle hole 34.

When electric power is supplied to the coil 51, the coil 51 induces a magnetic field, and magnetic fluxes flow through a magnetic circuit formed of the housing plate 14, the magnetic members 11 and 13, the cores 21 and 22 and the cover 15. Therefore, a magnetic attracting force is induced between the cores 21 and 22 placed away from each other. When this magnetic attracting force exceeds the pushing force of the spring 26, the core 22 and the needle valve 40 attached to each other are moved toward the rear side to approach the core 21. As a result, the sealing portion 42 of the needle valve 40 leaves the valve seat 32, so that the injector 1 is set to the valve opening state.

During the valve opening state, fuel entering the fuel inlet 191 of the connector 19 flows through the filter 18, the inner opening of the adjusting pipe 28 placed on the inner side of the housing 10, the inner opening of the core 21, the inner opening of the core 22, and the inner opening of the needle valve 40 in that order. Then, the fuel flows outside the valve 40 through a fuel hole 45. This hole 45 communicates the inner opening of the valve 40 and the outside of the valve 40. Then, the fuel flows through an opening between the housing 10 and the valve 40 and an opening between the valve 40 and the holder 14. Then, the fuel passes through an opening between the valve 40 and the nozzle body 30 and an opening between the sealing portion 42 and the valve seat 32. Then, the fuel is injected from the nozzle holes 34 into a chamber of the engine head.

When the electric power supplied to the coil 51 is stopped, the magnetic attracting force between the cores 21 and 22 disappears. Therefore, the core 22 and the needle valve 40 attached to each other are moved due to the pushing force of the spring 26 toward the front side and is placed away from the core 21. As a result, the sealing portion 42 of the needle valve 40 is again seated on the valve seat 32. Therefore, the injector 1 is returned to the valve closing state, and the fuel injection from the holes 34 is stopped.

Next, the action of the covering layer 5 will be described.

During the fuel injection, a portion of the fuel outputted from the outlet openings 341 of the holes 34 remains on the covering layer 5 attached to the surface 331 of the plate 33 around the outlet openings 341 of the holes 34. Assuming that the surface 331 of the plate 33 is directly exposed to the fuel, fuel remaining on the surface 331 will be solidified or caked as deposits on the surface 331. However, in this embodiment, the covering layer 5 having a high hydrophilic property exists on the surface 331 of the plate 33. This covering layer 5 prevents fuel remaining on the layer 5 from being solidified or caked as deposits on the layer 5.

More specifically, the covering layer 5 having a high hydrophilic property successively collects water contained in the fuel to form a film of the water on the layer 5. When a portion of fuel injected from the holes 34 remains on the covering layer 5 as residues containing non-burned carbons, P, Zn, Si, compounds of carboxylic acids and base components, and the like, the fuel residues float on the water film. In this case, the injection flow of the fuel easily removes the fuel residues from the water film successively formed. Therefore, the covering layer 5 prevents a portion of fuel from being remaining as residues on the layer 5, so that the covering layer 5 prevents the generation of deposits from fuel residues and the deposition of the deposits on the layer 5.

Accordingly, because the covering layer 5 having a high hydrophilic property is placed on the surface 331 of the plate 33, the injector 1 can prevent deposits of fuel from being solidified or caked on the surface of the nozzle body 30 around the outlet openings 341 of the holes 34.

Modification of Embodiment 1

Figure 4:
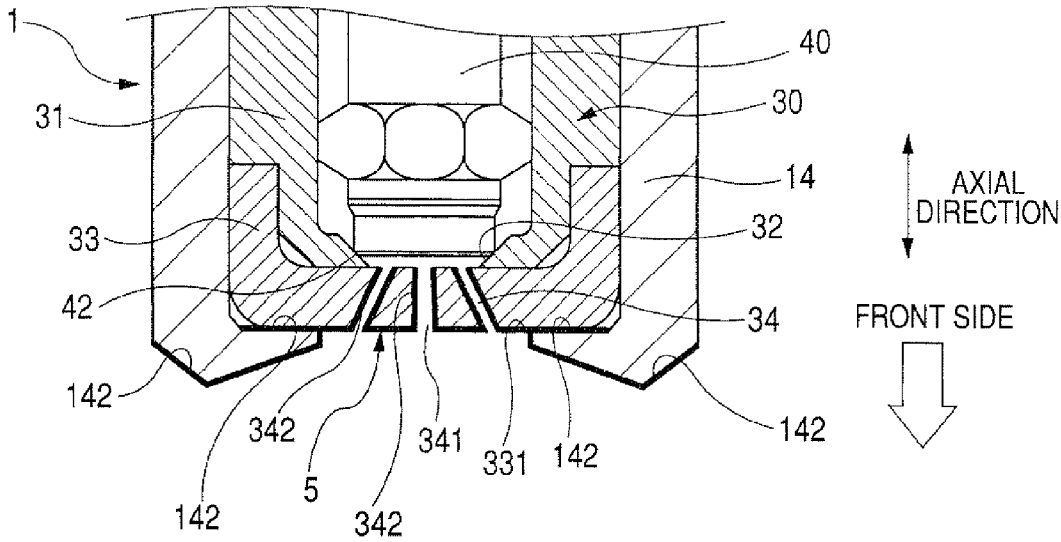
FIG. 4 is an enlarged view of a covering layer attached to a surface of a nozzle body according to a modification of the first embodiment.

FIG. 4 is an enlarged view of the covering layer 5 attached to surfaces of the nozzle body 30 according to a modification of the first embodiment. In the injector 1 according to the first embodiment, the covering layer 5 having a high hydrophilic property is attached to only the surface 331 of the nozzle hole plate 33 of the nozzle body 30 around the outlet openings 341 of the respective holes 34. However, as shown in FIG. 4, because fuel injected from the holes 34 passes across inner circumferential surfaces 342 of the holes 34, the covering layer 5 may be attached to the inner circumferential surfaces 332 of the holes 34 as well as the surface 331 of the plate 33. Further, because fuel sprayed from the holes 34 comes in contact with surfaces 142 of the front end portion 141 of the nozzle holder 14, the covering layer 5 may be attached to the surfaces 142 of the nozzle holder 14.

Accordingly, the injector 1 can prevent deposits of fuel from being solidified or caked on the inner circumferential surfaces 332 of the holes 34 and/or the surfaces 142 of the nozzle holder 14.

The covering layer 5 may be attached to a surface of the needle valve 40 around the sealing portion 42. In this case, the injector 1 can prevent deposits of fuel from being solidified or caked on the surface of the needle valve 40 around the sealing portion 42. Further, the covering layer 5 attached to the surface of the needle valve 40 can reduce the sliding frictional resistance between the needle valve 40 and the nozzle body 30.

Embodiment 2

In the first embodiment, the nozzle body 30 has the nozzle body wall 31 and the nozzle hole plate 33 which are separately formed and are attached to each other as one unit in the injector 1. However, the nozzle body wall 31 and the nozzle hole plate 33 may be integrally formed.

Figure 5:
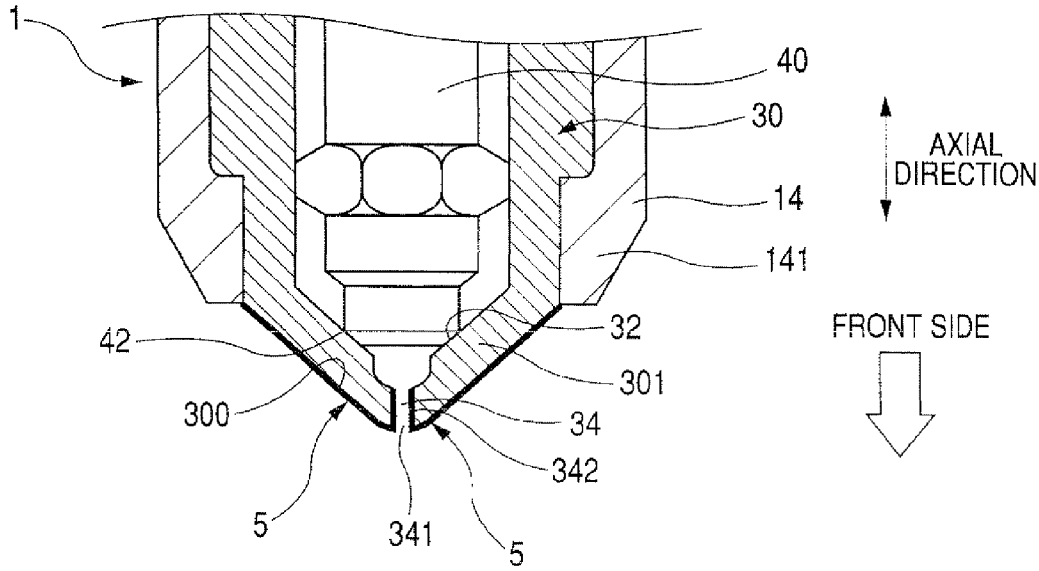
FIG. 5 is an enlarged view of a covering layer attached to surfaces of a nozzle body according to the second embodiment.

FIG. 5 is an enlarged view of the covering layer 5 attached to surfaces of a nozzle body according to the second embodiment.

As shown in FIG. 5, the nozzle body 30 has a wall portion fixed to the inner circumferential surface of the holder 14 and a conical portion 301 extending from the front end of the wall portion. These portions are integrally formed with each other. The valve seat 32 is disposed on the inner circumferential surface of the conical portion 301. The nozzle holes 34 are disposed at the front end of the conical portion 301 of the body 30. The conical portion 301 of the body 30 is protruded from the holder 14.

The covering layer 5 is attached to an outer circumferential surface 300 of the conical portion 301 of the body 30 around the outlet openings 341 of the holes 34 and the inner circumferential surfaces 342 of the holes 34.

Because the outlet openings 341 of the holes 34 are placed at the front end of the conical portion 301, the water film formed on the covering layer 5 is easily gathered around the outlet openings 341 while containing residues of fuel. Accordingly, the fuel injected from the holes 34 can efficiently remove the fuel residues gathered around the holes 34 from the water film.

Experimental Results for Estimating Deposits

The injector 1 with the covering layer 5 coated on the surface 331 of the plate 33 of the nozzle body 30 around the outlet openings 341 of the holes 34 was prepared as an inventive sample. Another injector with no covering layer was prepared as a comparative sample. Each of the samples were mounted in an engine, and the engine was operated for a predetermined time. Thereafter, fuel deposits attached to the surface 331 of the plate 33 in the comparative sample and fuel deposits attached to the covering layer 5 in the inventive sample were observed to measure a change in the flow rate of fuel sprayed into a chamber of the engine head and to measure a change in the spray angle of the fuel.

Each sample was mounted at the center of the engine. The temperature at the front end of the sample was approximately 250° C. The engine speed was approximately 2000 rpm. The fuel pressure was approximately 12 Mpa. The driving torque of the engine was approximately SON/m. The operation time of the engine was four hours.

Figure 6:
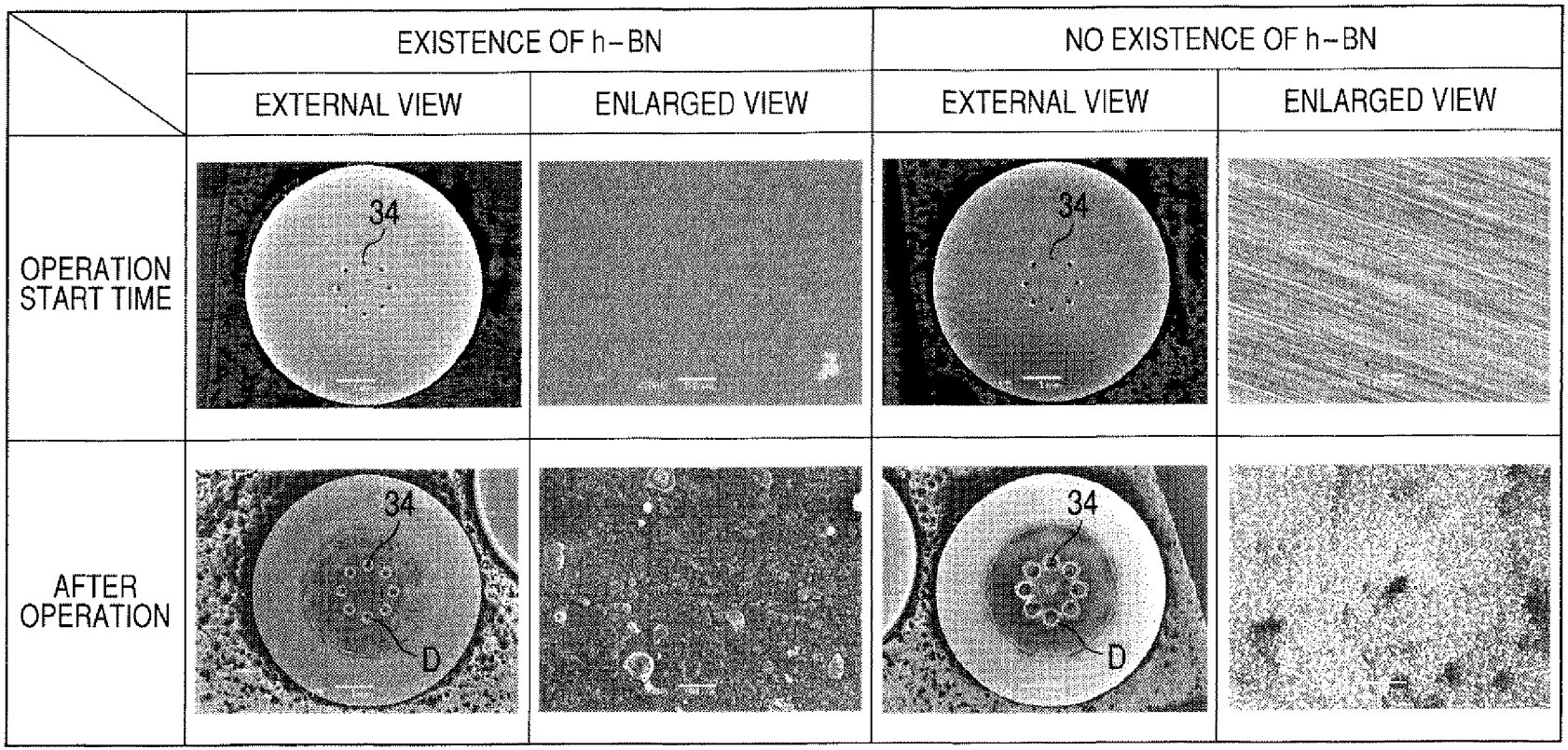
FIG. 6 is an explanatory view of deposits formed on the surface of the nozzle body.

Experimental results will be described with reference to FIG. 6 to FIG. 8. FIG. 6 is an explanatory view of deposits on the covering layer 5 and deposits on the surface 331 of the plate 33. Deposits shown in FIG. 6 were observed by using a scanning electron microscope (SEM).

As shown in FIG. 6, no deposits are formed at a start time of the engine operation. However, in the comparative sample, a large quantity of deposits are formed on the surface 331 of the plate 33 after the operation of the engine. In contrast, in the inventive sample, a quantity of deposits formed on the covering layer 5 after the operation of the engine is very small.

Accordingly, it will be realized that the covering layer 5 coated on the surface 331 of the plate 33 can effectively prevent fuel deposits from being formed on the layer 5.

Figure 7:
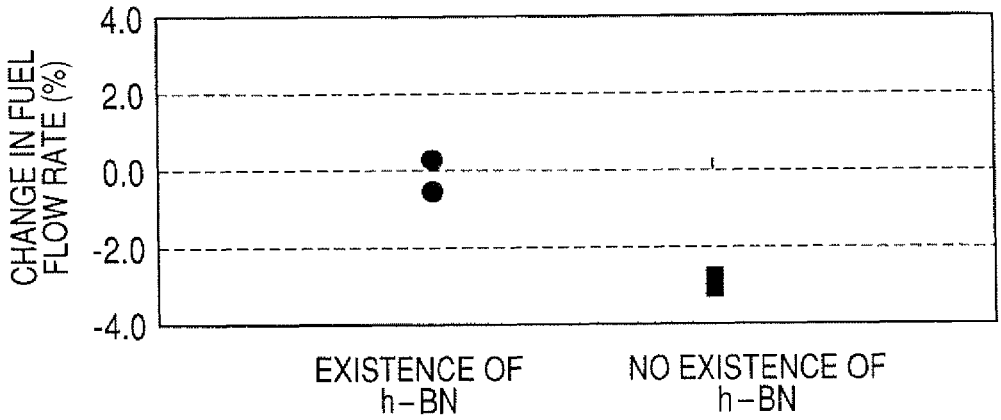
FIG. 7 is an explanatory view showing a change in a flow rate of sprayed fuel.
Figure 8:
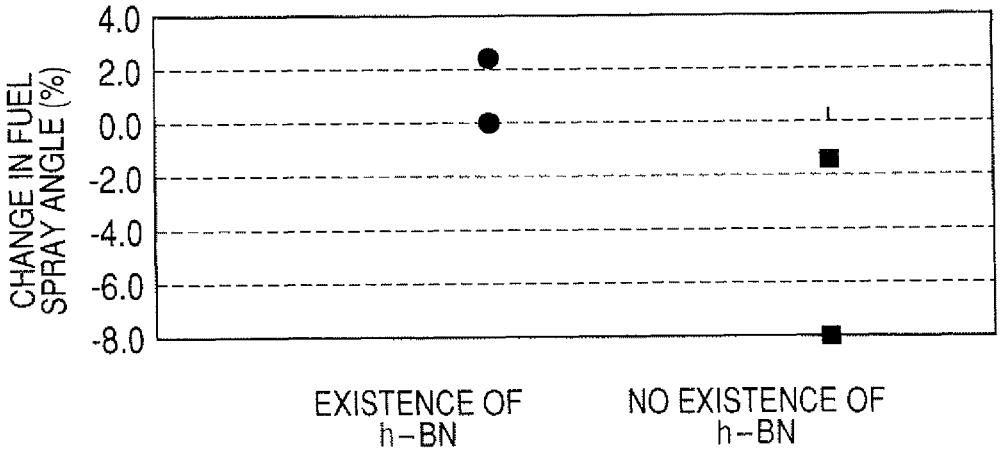
FIG. 8 is an explanatory view showing a change in a spray angle of fuel.

FIG. 7 is an explanatory view showing a change in a flow rate of the sprayed fuel, while FIG. 8 is an explanatory view showing a change in a spray angle of the fuel.

A first flowrate of the injected fuel in each sample was measured at the operation start time, and a second flow rate of the injected fuel in each sample was measured after the operation of the engine. Then, a flow rate difference was obtained by subtracting the first flow rate from the second flow rate, and a ratio (%) of the flow rate difference to the first flow rate was calculated. This experiment was performed twice for each sample.

Further, a first spray angle of the injected fuel in each sample was measured at the operation start time, and a second spray angle of the injected fuel in each sample was measured after the operation of the engine. Then, an angle difference was obtained by subtracting the first spray angle from the second spray angle, and a ratio (%) of the angle difference to the first spray angle was calculated. This experiment was performed twice for each sample.

As shown in FIG. 7 and FIG. 8, in the comparative sample having no h-BN, the ratios are largely lower than 0.0%. Therefore, the flow rate of the injected fuel and the spray angle of the injected fuel are reduced together in the comparative sample. In contrast, in the inventive sample coated with h-BN, the ratios are substantially equal to 0.0%. Therefore, none of the flow rate of the injected fuel and the spray angle of the injected fuel are changed during the engine operation in the injector 1.

Accordingly, it will be realized that the covering layer 5 coated on the surface 331 of the plate 33 can effectively maintain the fuel injecting performance such as the flow rate of the injected fuel and the spray angle of the injected fuel.

These embodiments should not be construed as limiting the present invention to structures of those embodiments, and the structure of this invention may be combined with that based on the prior art.

What is claimed is:

1. A fuel injection valve, comprising:

a valve guide with a valve seat placed on an inner surface of the valve guide and a nozzle hole from which fuel is injected;

a valve member movable along an axial direction of the valve guide to be seated on the valve seat of the valve guide and to leave the valve seat, the valve member seated on the valve seat closing the nozzle hole of the valve guide, the valve member opening the nozzle hole when leaving the valve seat; and a covering layer disposed on a surface of the valve guide around an outlet opening of the nozzle hole, wherein the covering layer has a hydrophilic property higher than that of the surface of the valve guide, the covering layer is made of boron nitride in a hexagonal crystal system, and the covering layer forms a film of water thereon such that residues of the fuel residues float on the water film.

2. The fuel injection valve according to claim 1, wherein the covering layer is also disposed on an inner surface of the nozzle hole.

3. The fuel injection valve according to claim 1, wherein the valve member has a sealing portion seated on the valve seat of the valve guide, and the covering layer is also disposed on a surface of the valve member around the sealing portion.

4. The fuel injection valve according to claim 1, wherein the covering layer has a thickness ranging from 20 nm to 10 μm.

5. The fuel injection valve according to claim 1, wherein the covering layer has a contact angle of water lower than 90 degrees.

6. The fuel injection valve according to claim 5, wherein the contact angle of water in the covering layer is set approximately at 70 degrees.

7. The fuel injection valve according to claim 1, wherein the covering layer is deposited on the surface of the valve guide according to a plasma chemical vapor deposition.

* * * * *